US007014356B2

(12) United States Patent
Bobe et al.

(10) Patent No.: US 7,014,356 B2
(45) Date of Patent: Mar. 21, 2006

(54) CHRONOGRAPH

(75) Inventors: Tino Bobe, Glashütte-Johnsbach (DE); Jens Schneider, Glashütte-Johnsbach (DE)

(73) Assignee: Lange Uhren GmbH, Glashuette (DE)

( * ) Notice: Subject to any disclaimer, the term of this patent is extended or adjusted under 35 U.S.C. 154(b) by 0 days.

(21) Appl. No.: 11/099,920

(22) Filed: Apr. 6, 2005

(65) Prior Publication Data

US 2005/0249043 A1 Nov. 10, 2005

(30) Foreign Application Priority Data

Apr. 6, 2004 (DE) ..... 10 2004 017 345

(51) Int. Cl.
*G04F 7/00* (2006.01)

(52) U.S. Cl. ..... 368/102; 368/106

(58) Field of Classification Search ..... 368/97, 368/101–106, 112

See application file for complete search history.

(56) References Cited

U.S. PATENT DOCUMENTS 253,338 A * 2/1882 Audemars ..... 368/104
355,403 A * 1/1887 Lecoultre ..... 368/102
394,933 A * 12/1888 Piquet ..... 368/102
426,396 A * 4/1890 Schlatter ..... 368/102
479,900 A * 8/1892 Piquet ..... 368/102
550,182 A * 11/1895 Lecoultre-Piguet ..... 368/102
552,715 A * 1/1896 Lugrin ..... 368/102
2,548,101 A * 4/1951 Dubey et al. ..... 368/102
5,122,995 A * 6/1992 Vuilleumier ..... 368/102
6,842,403 B1 1/2005 Meis

FOREIGN PATENT DOCUMENTS

DE 1 003 141 2/1957

* cited by examiner

*Primary Examiner*—Vit W. Miska
(74) *Attorney, Agent, or Firm*—Cohen, Pontani, Lieberman & Pavane

(57) ABSTRACT

A chronograph has a clock movement for driving a second chronograph hand and a minute chronograph hand and a control apparatus for stopping the second chronograph hand and the minute chronograph hand and for setting in motion a rattrapante mechanism of a second rattrapante indicator and a minute rattrapante indicator. The rattrapante mechanism has a common trip element for starting and stopping the second rattrapante indicator and the minute rattrapante indicator. A catch is triggered by the common trip element for engaging or disengaging from a ratchet recess of a plurality of ratchet recesses that are distributed evenly on the periphery of a minute rattrapante wheel. The minute rattrapante wheel is connected to a minute rattrapante shaft of a minute rattrapante indicator. The number of ratchet recesses on the minute rattrapante wheel corresponds to the number of increments of the minute chronograph hand per revolution.

20 Claims, 2 Drawing Sheets

CHRONOGRAPH

BACKGROUND OF THE INVENTION

1. Field of the Invention

The invention relates to a chronograph having a clock movement by which a second chronograph hand and a minute chronograph hand can be rotatably driven, a control apparatus for stopping the second chronograph hand and the minute chronograph hand and for setting in motion a rattrapante mechanism for a second rattrapante indicator and a minute rattrapante indicator, the rattrapante mechanism having a trip element for starting and stopping the second rattrapante indicator and the minute rattrapante indicator.

2. Description of the Related Art

In chronographs having second and minute chronograph hands and a control for stopping the second and minute chronograph hands and setting a rattrapante indicator mechanism of a second rattrapante indicator and minute rattrapante indicator, a fine-toothed wheel of the minute rattrapante indicator mechanism is clamped between two clamps acting on opposing sides to arrest the minute rattrapante indicator. This configuration requires a large number of components and a large construction space.

SUMMARY OF THE INVENTION

An object of the present invention is to provide a chronograph having second and minute chronograph hands, a control apparatus for stopping the second and minute hands and mechanism, and a rattrapante mechanism for a second rattrapante indicator and a minute rattrapante indicator, which has a few simple components, requires a small construction space and offers high operating reliability.

This object is achieved according to the invention by a chronograph in which a rattrapante mechanism has a common trip element for the second rattrapante indicator and the minute rattrapante indicator, the common trip element being arranged for triggering a catch such that the catch may be engaged in or disengaged from a ratchet recess of plural ratchet recesses distributed evenly spaced on the periphery of a minute rattrapante wheel, the minute rattrapante wheel being connected to a shaft of a minute rattrapante indicator. The number of ratchet recesses on the minute rattrapante wheel corresponds to the number of increments of the minute chronograph hand per revolution.

The common trip element for the second rattrapante indicator and the minute rattrapante indicator ensures that the starting and stopping of the second rattrapante indicator and the minute rattrapante indicator is realized simultaneously.

As a result of the catch which engages in the ratchet recesses, the minute rattrapante wheel is not only arrested, but at the same time precisely aligned in terms of its minute position which thereby also assures a correct reading of the recorded interval.

The small number of necessary components produces both operating reliability and a low construction space requirement.

For simple synchronization of the minute rattrapante indicator with the minute chronograph hand, the minute rattrapante indicator wheel may be coupled by a minute rattrapante hammer to a minute rattrapante heart which is fixed with respect to rotation to a hand shaft of the minute chronograph hand.

A particularly compact configuration is herein achieved, if the minute rattrapante heart is fixedly connected to a minute counter wheel bearing the hand shaft of the minute chronograph hand.

Particular space savings is achieved if the minute rattrapante wheel and the minute rattrapante heart are disposed rotatably about a common rotation axis.

For the simple coupling of minute rattrapante wheel and rattrapante heart and for the automatically correct assignment of the minute rattrapante hammer to the minute rattrapante heart, the minute rattrapante hammer has one end pivotably mounted on the minute rattrapante wheel for movement about an axis parallel to the rotation axis. The other end of the minute rattrapante hammer may be urged by a spring force against the minute rattrapante heart.

If the minute rattrapante hammer is pressed against the minute rattrapante heart by a spring element attached to the minute rattrapante wheel, then this spring element, too, is transported always in its correct position with respect to the minute rattrapante hammer.

To stop the minute rattrapante indicator, the minute rattrapante hammer is disengaged from the minute rattrapante heart by a decoupling device which is actuated by the trip element.

In one embodiment, the decoupling device has an isolator wheel disposed such that it is rotatable coaxially to the minute rattrapante wheel, and an isolator lever which is driven pivotably about an isolator axis parallel to the rotation axis of the minute rattrapante wheel by a certain rotation angle between a decoupling setting and a coupling setting. The isolator wheel is driven rotatably by a certain rotation angle about the rotation axis. The isolator wheel includes a stop acting on the minute rattrapante hammer to decouple the minute rattrapante hammer from the minute rattrapante heart. According to this embodiment, the decoupling device has a compact construction with simple components and is easy to actuate. For secure driving by the isolator lever, the isolator wheel may include a radially encircling toothing, especially a saw toothing, and the isolator lever with a corresponding counter-toothing, which, in the coupling setting, engages in the toothing of the isolator wheel.

The decoupling device is preferably actuated by a control lever, which can be driven by the trip element out of a coupling position into a decoupling position, counter to a spring force, pivotably about a control lever axis. The isolator lever being pressed pivotably by the control lever counter to the spring force.

In multiple function, and thereby economizing on parts and construction space, the control lever may have a stop by which the catch, in the coupling setting of the control lever, is urged such that the catch is disengaged from the ratchet recess.

A component-saving construction is obtained if the catch is disposed at the free end of a spring arm preloaded radially toward the minute rattrapante wheel.

To define the position of the control lever in its decoupling position, the control lever bears against a stop when the control lever is in the decoupling position. The stop may comprise a stop eccentric.

If the common trip element is a rotatably drivable column wheel having columns which are evenly spaced in radially encircling arrangement, then a simple and secure drive mechanism, both for the second rattrapante indicator and for the minute rattrapante indicator, is obtained.

The control lever may in this case be driven, by the columns, pivotably out of its decoupling position into its coupling position.

The column wheel is preferably configured with ratchet teeth disposed evenly spaced in radially encircling arrangement, which are double in number to the number of columns and by which the column wheel can be rotatably driven. A detent spring capable of engaging resiliently in the tooth spaces between the ratchet teeth may be used to secure the positions of the column wheel.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
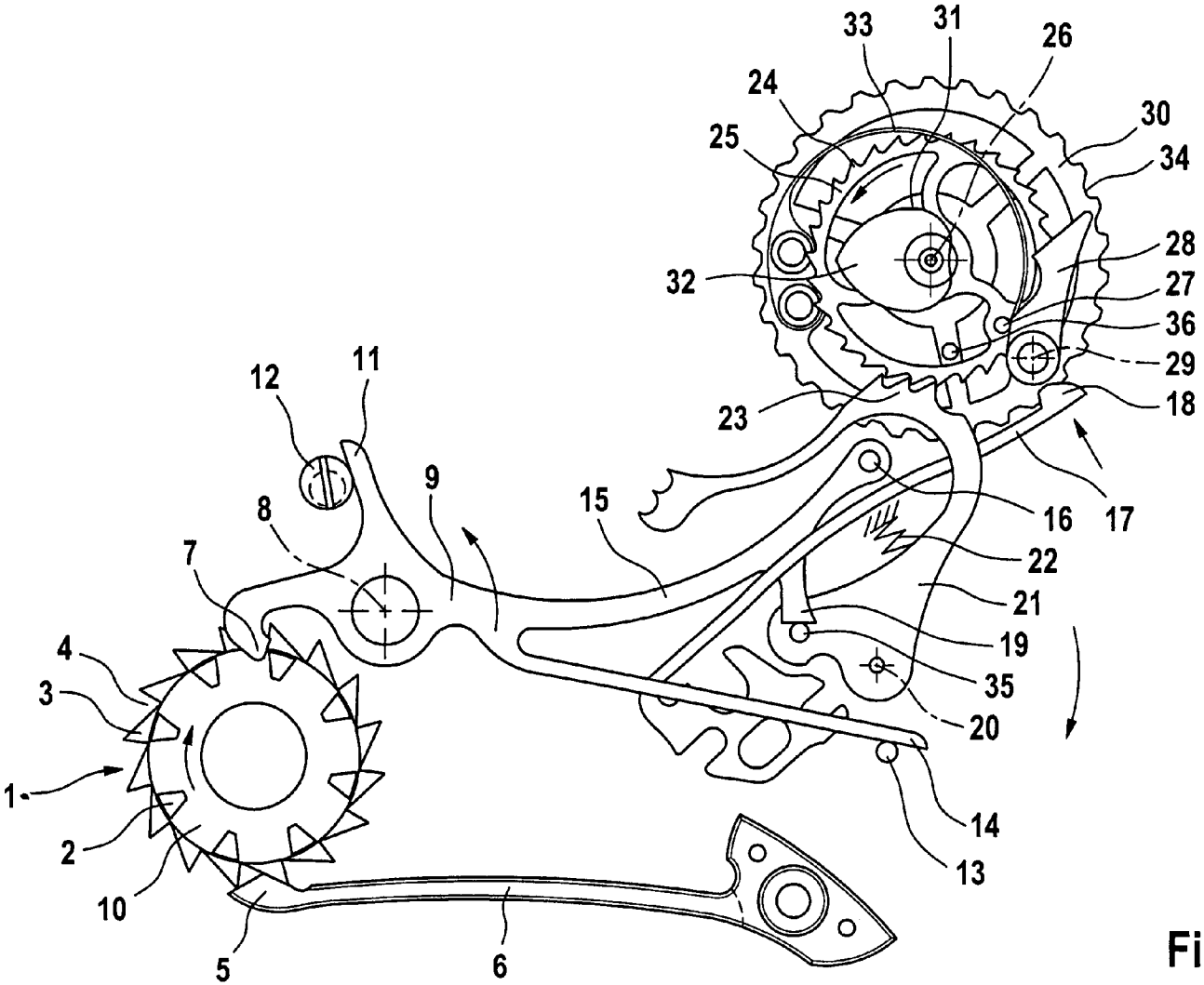
FIG. 1 is a schematic view of a portion of a rattrapante indicator mechanism according to the invention in a stop position.

FIG. 1 shows a portion of a rattrapante mechanism of a chronograph according to the present invention including a column wheel 1 which is rotatably actuatable by a pusher (not shown). The chronograph in which the rattrapante mechanism is arranged comprises chronograph minute and second hands and a mechanism for starting and stopping the chronograph minute and second hands as disclosed, for example, in U.S. Pat. No. 6,842,403, the entire contents of which are incorporated herein by reference. The column wheel 1 has eight axially projecting columns 2 evenly distributed in encircling arrangement and sixteen ratchet teeth 3 evenly distributed on the periphery. A catch 5 of a detent spring 6 is resiliently engaged in one of the tooth spaces 4 between the the ratchet teeth 3.

A control lever 9 is mounted pivotably about a control lever axis 8. A finger 7 of the control lever 9 engages in gaps 10 between the columns 2. When the column wheel 1 is turned in the clockwise direction, the finger 7 is lifted in a ramp-like manner out of a gap 10 and slides on the outer periphery of the column 2 until falling again into the following gap 10.

Figure 2:
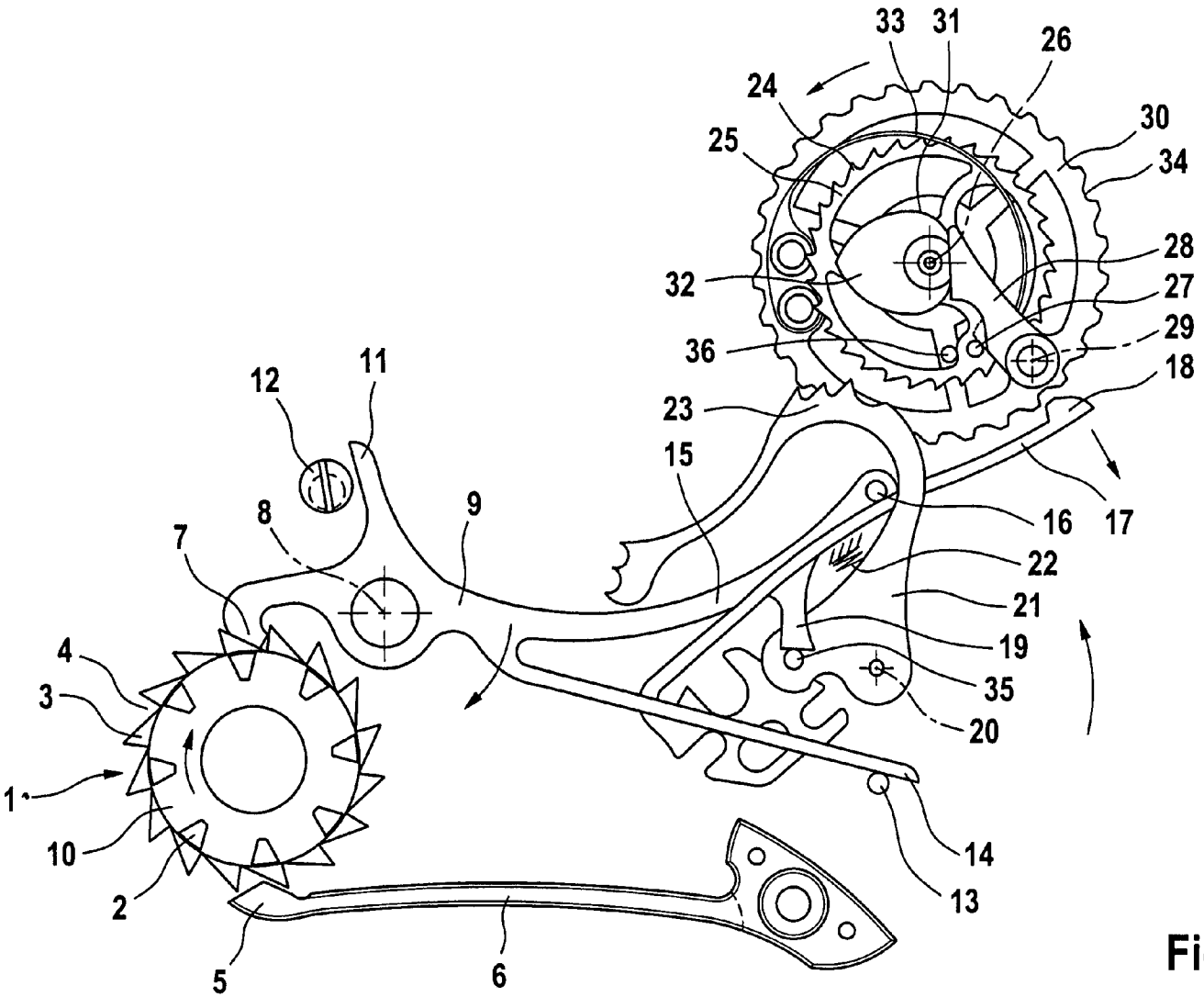
FIG. 2 is a schematic view of the portion of the rattrapante indicator mechanism according to FIG. 1 in a travel position.

As a result of the finger 7 or pawl being lifted out of a gap 10, the control lever 9 is pivoted from a decoupling position of the control lever 9 shown in FIG. 1 into a coupling position of the control lever 9 shown in FIG. 2.

In the decoupling position, a stop arm 11 connected to the control lever 9 bears against a stop eccentric 12. The stop arm 11 is spring-loaded against the stop eccentric 12 by a spring arm 14 disposed in one piece on the control lever 9 and supported against a pin 13.

The control lever 9 also includes an actuating arm 15 having a free end region with a stop 16 and which is actuatable to deflect a spring arm 17 whose one end is fixed and whose free end bears a catch 18.

The control lever 9 further includes a projection 19 on its actuating arm 15 which acts on an isolator lever 21 when the control lever 9 is pivoted out of its decoupling setting into its coupling setting. The isolator lever 21 is pivotable about an isolator axis 20, parallel to the control lever axis 8, counter to the force of a spring 22, from a coupling position of the isolator lever 21 (FIG. 1) to a decoupling setting of the isolator lever 21 (FIG. 2).

The isolator lever 21, at a region radially distanced from the isolator axis 20, has three teeth of a counter-toothing 23. When the isolator lever 21 is pivoted out of the decoupling setting and into the coupling setting, the teeth of the counter-toothing 23 engage in a radially encircling saw toothing 24 of an isolator wheel 25 and turn the isolator wheel 25 by a certain rotation angle in the counter-clockwise direction.

The isolator wheel 25 is mounted rotatably about a rotation axis 26 parallel to the control lever axis 8 and bears a stop 27. A minute rattrapante hammer 28 is rotatably arranged on a minute rattrapante wheel 30 for pivoting about an axis 29 parallel to the rotation axis 26. The stop acts 27 on the minute rattrapante hammer 28 when the isolator wheel 25 is rotated relative to the minute rattrapante wheel 30, for pivoting the minute rattrapante hammer 28 about the axis 29.

The minute rattrapante wheel 30 is mounted rotatably about the rotation axis 26. An end region of the minute rattrapante hammer 28 distal from the axis 29 acts on a radially encircling heart cam 31 of a minute rattrapante heart 32. This minute rattrapante heart 32 is likewise rotatable about the rotation axis 26 and is fixedly connected to a minute counter wheel (not shown) of the chronograph, which bears the hand shaft of a minute chronograph hand.

The minute rattrapante hammer 28 is pressurized against the heart cam 31 of the minute rattrapante heart 32 by a preloaded spring arm of a spring element 33 attached by one end to the minute rattrapante wheel 30. The minute rattrapante wheel 30 has, evenly distributed on its radially encircling periphery, thirty ratchet recesses 34 each having a shape corresponding to the shape of the catch 18 and in which the catch 18 is engagable.

The chronograph has a second chronograph hand (not represented) and a minute chronograph hand, the minute chronograph hand being able to be driven rotatably in thirty increments per revolution. The second chronograph hand is assigned a second rattrapante indicator and the minute chronograph hand is assigned the minute rattrapante indicator, which can likewise be advanced in thirty increments per revolution.

The rattrapante indicator mechanism of both rattrapante indicators has the column wheel 1 as the common trip element.

If, when the second and minute chronograph hands are running, the accompanying second and minute rattrapante indicators are to be stopped, the column wheel 1 is rotated by one pitch of the ratchet teeth 3. The finger 7 thereby falls into a gap between two columns 2. Upon this, the control lever 9 is also pivoted counter-clockwise, until coming to bear against the stop eccentric 12.

Since, now, the stop 16 is no longer keeping the spring arm 17 deflected, the catch 18 moves into a ratchet recess 34 of the minute rattrapante indicator wheel 30 and blocks its further rotational motion and hence also the rotational motion of the minute rattrapante indicator.

The pivot motion of the control lever 9 simultaneously gives rise, under the action of the spring 22, to a pivot motion of the isolator lever 21 in the clockwise direction, so that its counter-toothing 23 enters into engagement with the saw toothing 24 of the isolator wheel 25 and turns the latter by a certain angle. The stop 27 hereupon comes to bear against the minute rattrapante indicator lever 28 and lifts the minute rattrapante indicator lever 28, counter to the force of the spring element 33, from the minute rattrapante indicator heart 32, so that the heart cam 31, and hence also the minute chronograph hand connected thereto by the minute counter wheel, can continue turning without obstruction.

If, now, the minute rattrapante indicator is meant to advance again synchronously with the minute chronograph hand, the column wheel 1 is turned onward by one pitch of the ratchet teeth 3. This causes the finger 7 to be lifted in a ramp-like manner out of the gap between two columns 2 and to come to bear upon the peripheral outer face of a column 2. At the same time, the control lever 9 is thereby pivoted in the clockwise direction, whereby, by means of the stop 16, the spring arm 17 is pivoted and its catch 18 is lifted out of the ratchet recess 34.

In addition, the pressurization of a stop 35 of the isolator lever 21 by the projection 19 of the control lever 9 causes the isolator lever 21 to pivot in the counter-clockwise direction. Its counter-toothing 23 thus disengages from the saw toothing 24 of the isolator wheel 25, so that the spring element 33 brings the minute rattrapante indicator lever 28 back into bearing contact against the heart cam 31 of the minute rattrapante indicator heart 32. This then turns under the radial pressurization of the minute rattrapante indicator lever 28, until the latter bears against the radially smallest extent of the minute rattrapante indicator heart 32, so that the minute chronograph hand and the minute rattrapante indicator coincide and continue turning synchronously.

To ensure that the isolator wheel 25 is able to move with its stop 27 away from the minute rattrapante indicator lever 28 only by the defined pivot angle, this motion is limited by a stop 36 of the minute rattrapante indicator wheel 30.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rattrapante mechanism for a chronograph having a clock movement for rotably driving a second chronograph hand and, in a discrete number of increments per revolution, a minute chronograph hand and a control apparatus for stopping the second and minute chronograph hands, said rattrapante mechanism being arranged for starting and stopping second and minute rattrapante indicators on the chronograph, said rattrapante mechanism comprising:

a common trip element actuatable for starting and stopping the second and minute rattrapante indicators;

a minute rattrapante wheel connected to a minute rattrapante shaft of the minute rattrapante indicator, said minute rattrapante wheel having a periphery and a plurality of evenly distributed ratchet recesses defined on said periphery, the number ratchet recesses in said plurality of ratchet recesses corresponding to the number of discrete increments of the minute chronograph hand per revolution; and a catch triggered by said common trip element for engaging and disengaging one of said plurality of ratchet recesses.

2. The rattrapante mechanism of claim 1, further comprising a minute rattrapante heart fixed with respect to rotation to a shaft of the minute chronograph hand and a minute rattrapante hammer arranged and dimensioned for coupling said minute rattrapante wheel to said minute rattrapante indicator heart.

3. The rattrapanted mechanism of claim 2, wherein said minute rattrapante heart is fixedly connected to a minute counter wheel bearing the hand shaft of the minute chronograph hand.

4. The rattrapante mechanism of claim 2, wherein each of said minute rattrapante wheel and said minute rattrapante heart is rotatable about a common rotation axis.

5. The rattrapante mechanism of claim 4, wherein one end of said minute rattrapante hammer is pivotally mounted on said minute rattrapante wheel for movement about an axis parallel to said common rotation axis and the other end is urged by a spring force against said minute rattrapante heart.

6. The rattrapante mechanism of claim 5, further comprising a spring element attached to said minute rattrapante wheel for urging said minute rattrapante hammer against said minute rattrapante heart.

7. The rattrapante mechanism of claim 2, further comprising a decoupling device actuatable by said common trip element for disengaging said minute rattrapante hammer from said minute rattrapante heart.

8. The rattrapante mechanism of claim 7, wherein said decoupling device includes an isolator wheel rotatably arranged for coaxial rotation relative to said minute rattrapante wheel, and an isolator lever pivotally mounted for pivoting about an isolator axis parallel to said common rotation axis between a decoupling setting and a coupling setting, said isolator wheel being driven rotatably by a certain rotation angle when said isolator lever is moved from said decoupling setting to said coupling setting, said isolator wheel having a stop acting on said minute rattrapante hammer for decoupling said minute rattrapante hammer from said minute rattrapante heart when said isolator lever is in said coupling setting.

9. The rattrapante mechanism of claim 8, wherein said isolator wheel includes a radially encircling toothing, and said isolator lever comprises a corresponding counter-toothing arranged and dimensioned for engaging said toothing of said isolator wheel in the coupling setting of said isolator lever.

10. The rattrapante mechanism of claim 8, further comprising a control lever pivotably arranged for pivoting about a control lever axis between a coupling position and a decoupling position for actuating said decoupling device, said control lever being driven by said common trip element from the coupling position into the decoupling position counter to a spring force.

11. The rattrapante mechanism of claim 10, wherein said control lever acts on said isolator lever for pivoting said isolator lever counter to a spring force.

12. The rattrapante mechanism of claim 10, wherein said control lever comprises a stop acting on said catch for disengaging said catch from said one of said plurality of ratchet recess when said control lever is in the coupling position.

13. The rattrapante mechanism of 1, wherein said catch is arranged at a free end of a spring arm preloaded radially toward said minute rattrapante wheel.

14. The rattrapante mechanism of claim 10, further comprising a control lever stop, said control lever bearing against said control lever stop in the coupling position.

15. The rattrapante mechanism of claim 1, wherein said common trip element is a rotatably drivable column wheel having axially extending columns evenly distributed in radially encircling arrangement.

16. The rattrapante mechanism of claim 10, wherein said common trip element is a rotatably drivable column wheel having axially extending columns evenly distributed in radially encircling arrangement, said common trip element being arranged and dimensioned for driving, by said columns, said control lever pivotably from the coupling position into the decoupling position.

17. The rattrapante mechanism of claim 15, wherein said column wheel further comprises ratchet teeth evenly distributed in a radially encircling arrangement, the number of ratchet teeth being twice the number of columns, the column wheel being rotatably drivable by said ratchet teeth.

18. The rattrapante mechanism of claim 17, further comprising a detent spring arranged and dimensioned for resiliently engaging tooth spaces between said ratchet teeth on said column wheel.

19. The rattrapante mechanism of claim 14, wherein said control lever stop is an eccentric stop.

20. The rattrapante mechanism of claim 1, wherein said number of increments per revolution of the minute chronograph hand is thirty.

* * * * *